US007404549B2

(12) United States Patent
Meier et al.

(10) Patent No.: US 7,404,549 B2
(45) Date of Patent: Jul. 29, 2008

(54) TRANSPORTING MECHANISM HAVING A LINK CHAIN AND CLAMPS

(75) Inventors: Jörg Meier, Oftringen (CH); Jean-Claude Oppliger, Niederhasli (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/510,410

(22) Filed: Aug. 25, 2006

(65) Prior Publication Data

US 2006/0283690 A1 Dec. 21, 2006

Related U.S. Application Data

(63) Continuation of application No. 11/040,547, filed on Jan. 20, 2005.

(30) Foreign Application Priority Data

Jan. 21, 2004 (EP) ..... 04405040

(51) Int. Cl.
*B65H 29/04* (2006.01)

(52) U.S. Cl. ..... 270/52.14; 270/52.16; 270/52.19; 270/52.22; 198/867.02; 198/867.05; 198/867.07; 198/867.14; 198/803.3; 198/644; 198/470.1; 271/204; 271/277

(58) Field of Classification Search ..... 198/46.2, 198/867.02, 867.05, 867.07, 867.14, 803.3, 198/803.7, 803.9, 470.1; 270/52.16, 52.19, 270/52.22, 52.14, 52.25; 414/792.9; 271/204, 271/277

See application file for complete search history.

(56) References Cited

U.S. PATENT DOCUMENTS

| | | | | |
|---|---|---|---|---|
| 4,905,818 | A * | 3/1990 | Houseman | 198/803.7 |
| 6,227,589 | B1 * | 5/2001 | Brown et al. | 294/104 |
| 6,234,466 | B1 * | 5/2001 | Infanger | 270/52.23 |
| 6,578,843 | B2 * | 6/2003 | Honegger | 271/204 |
| 6,830,241 | B1 * | 12/2004 | Klopfenstein | 270/52.25 |

* cited by examiner

*Primary Examiner*—Gene O. Crawford
*Assistant Examiner*—Leslie A Nicholson, III
(74) *Attorney, Agent, or Firm*—Friedrich Kueffner

(57) ABSTRACT

A transporting mechanism includes a link chain and clamps which are attached to a chain link of the link chain and which are capable of gripping at least one printed product. At least two clamps are attached to each chain link of the link chain, wherein the clamps in the link chain are spaced apart from one another by equal spacings.

6 Claims, 3 Drawing Sheets

TRANSPORTING MECHANISM HAVING A LINK CHAIN AND CLAMPS

Continuation of prior application Ser. No. 11/040,547 filed Jan. 20, 2005.

BACKGROUND OF THE INVENTION

1. Field of the Invention

The present invention relates to a transporting mechanism having a link chain and clamps which are each fastened on a chain link of the link chain and by means of which in each case at least one printed product can be gripped.

2. Description of the Related Art

Transporting mechanisms of the type mentioned above have been known for some time in the printing industry. In particular, they are used for conveying newspapers. The newspapers are fed to the transporting mechanism in an imbricated stream formation and gripped by the transporting mechanism. The clamps here engage in the imbricated stream and each clamp grips a newspaper at the fold. The clamps are controlled by a guide and are opened and closed correspondingly. At the end of a conveying path, the newspapers are fed to another apparatus for further processing. For example, such an apparatus is used to set down the newspapers in groups. The clamps are opened again via the control guide. During the conveying operation, the printed products can be conveyed in any desired direction and, in particular, also through curves and around bends. They can also be worked on, for example, addressed, using an inkjet unit, during the conveying operation.

In the case of a transporting mechanism suitable for conveying printed products, and in particular newspapers, the production costs, the assembly costs, the wear and the service life and the noise during operation are significant factors.

The production costs are brought about, in particular, by the number of additional parts per meter and by the assembly costs. Additional parts are, in particular, running rollers, ball-and-socket joints and screw connections.

The wear occurring in the transporting mechanism is usually comparatively high, and depends on the conveying speed. The higher the conveying speed, the higher the level of wear and the shorter the service life of the transporting mechanism. If a transporting mechanism has to be replaced, then this results in a relatively long standstill period, and thus to operation being interrupted.

The development of noise likewise depends on the conveying speed, but also on other technical factors.

A desirable transporting mechanism would be one which is more cost-effective to produce and assemble, has a longer service life and, in addition, is quieter to operate.

The prior art has disclosed a transporting mechanism which has clamps by means of which always two printed products are gripped and conveyed at the same time. This transporting mechanism, however, has the disadvantage that the product thickness is usually restricted. Particularly thick products cannot be conveyed. It is also disadvantageous that the subsequent processing of the printed products is limited to even numbers of products. This is disadvantageous particularly for forming groups. It would be possible, if appropriate, for the two jointly conveyed products to be separated again. Separating products, however, is a difficult process which, in this case, would vastly reduce production reliability.

SUMMARY OF THE INVENTION

Therefore, it is the object of the present invention to provide a transporting mechanism of the above-mentioned type which is more cost-effective to produce, has a longer service life and, in addition, is quieter to operate. The transporting mechanism, at the same time, should avoid the above-mentioned disadvantages.

In accordance with the present invention, in a transporting mechanism of the above-described type, this object is achieved in that at least two clamps are fastened on each chain link of the link chain, and in that the clamps in the link chain are spaced apart from one another in each case by the same spacings.

The invention is based on the finding that, in the case of a transporting mechanism with a plurality of clamps per chain link, fewer additional parts, for example rollers or ball-and-socket joints, per meter are required. This results in significant advantages from an economic and technical point of view. Since fewer rollers are necessary per meter, the transporting mechanism runs significantly more smoothly. Since the number of additional parts can be reduced there are correspondingly fewer costs during production and assembly.

A significant aspect of the invention is also seen in that the chain links may be designed to be longer and the actuating forces of the clamps are thus better absorbed locally by a guide rail. High forces acting on the transporting mechanism can cause the latter and the drive to vibrate. The forces can be better distributed by longer chain links. The occurrence of vibrations can be reduced. It is thus possible, in particular, to reduce the loads acting on the chain joints, which results in a lower level of wear.

The smaller chain spacing which is possible results in a lower running speed, which means a lower level of noise development, a lower level of wear and a higher level of reliability. While maintaining the same capacity, a significantly lower running speed is achieved for the transporting mechanism according to the invention. The smaller chain spacing is easier to realize with two clamps on one chain link, and more favorable space conditions are achieved.

The various features of novelty, which characterize the invention, are pointed out with particularity in the claims annexed to and forming part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE INVENTION

Figure 3:
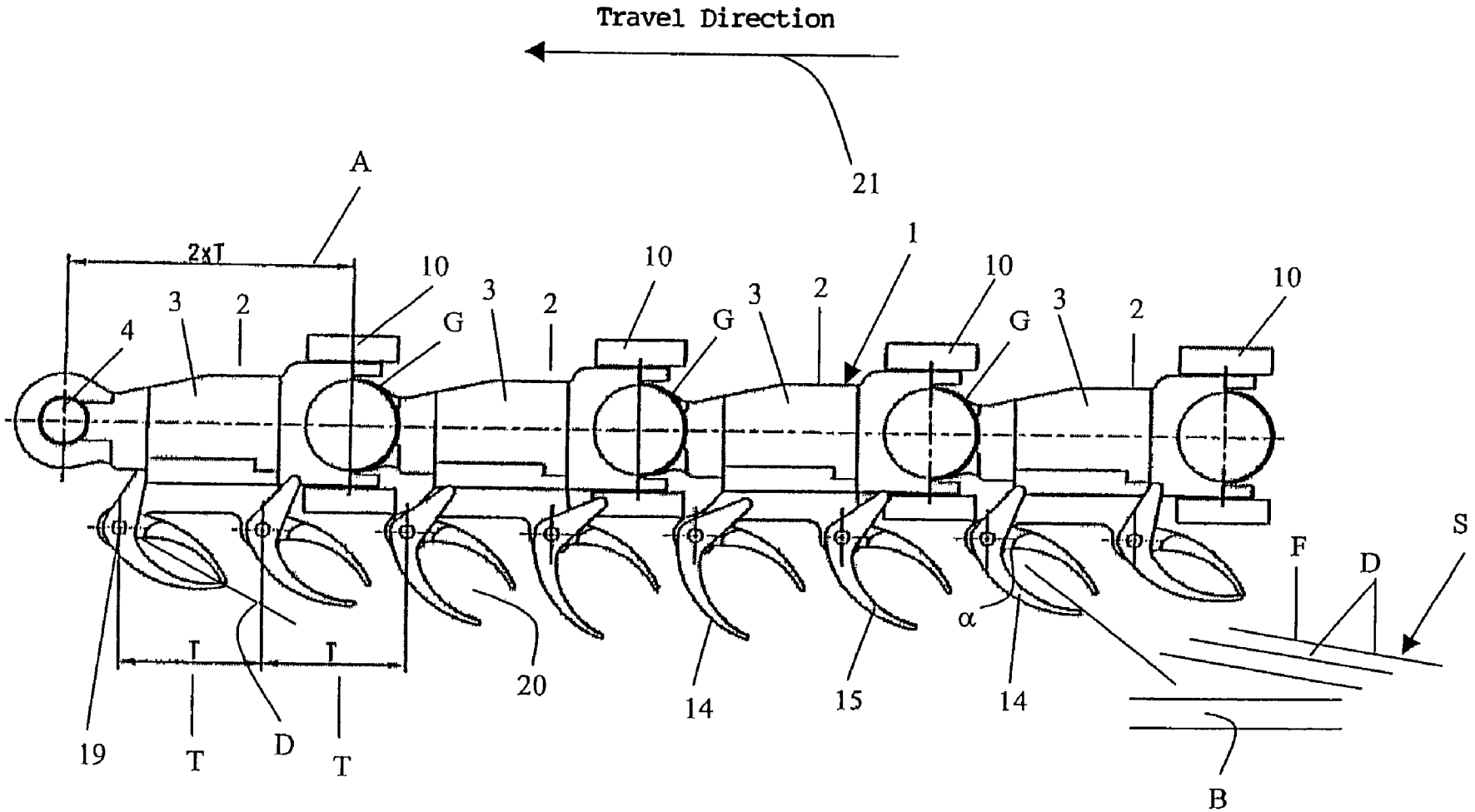
FIG. 3 is a view of part of the transporting mechanism according to the invention.
Figure 4:
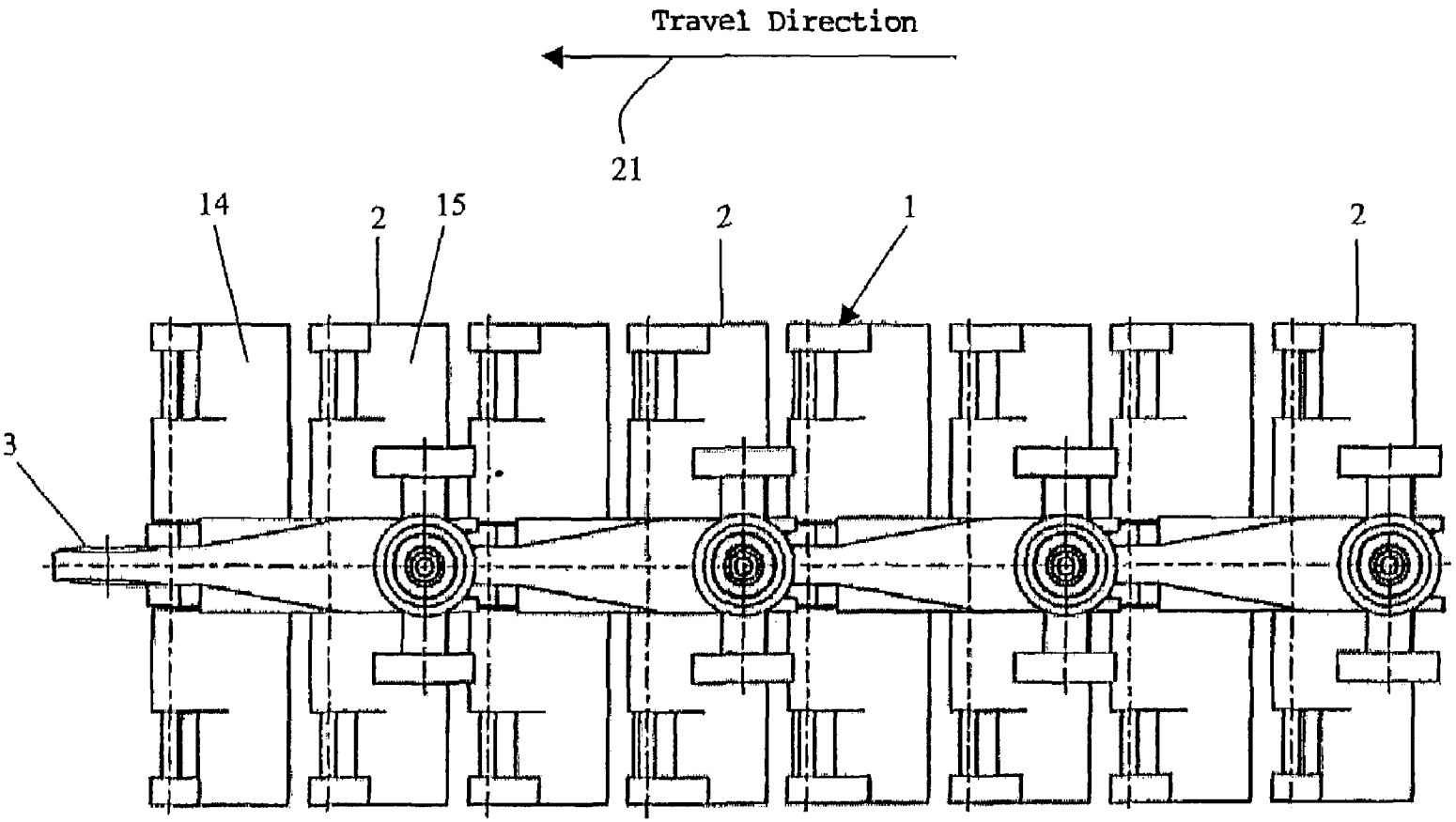
FIG. 4 is a further view of the transporting mechanism according to FIG. 3.

FIGS. 3 and 4 show part of the transporting mechanism 1 according to the invention with four chain links 2 which are fixed to one another so as to be capable of travelling in space. The joints G, by which the chain links 2 are connected to one another, are preferably ball-and-socket joints and, according to FIG. 1, have a socket 4 in which a ball is mounted, wherein this ball is fixed to the next chain link.

The transporting mechanism 1 may be guided in a cross-sectionally cruciform profile rail 1 which is open at the bottom and in which, of each chain link 2, four rollers 10, 11, 12, 13 are guided. The rollers 12 and 13 are fastened on a horizontal spindle 9, these spindles being mounted in bearing bores 8 of two lugs 7 of a body 3. The above-mentioned ball is located between these lugs 7. The two rollers 10 and 11 are fastened on a vertical spindle, not shown. This vertical spindle is likewise mounted in the body 3. The chain links 2 are guided in the above-mentioned profile rail by way of these rollers 10, 11, 12 and 13.

The conveying direction of the transporting mechanism 1 is indicated by the arrow 21 in FIG. 3. The transporting mechanism 1 is preferably endless and driven by a drive mechanism, not shown. Suitable drives are known to the person skilled in the art and need not be explained here.

Each chain link 2 has a front clamp 14 and a rear clamp 15. These two clamps 14 and 15 are fixed to a carrier 6 of the body 3. For example, the two clamps 14 and 15 can be screwed to the carrier 6 from beneath using fastening screws, not shown. The carrier 6 may be integrally formed on the body 3, which is produced, for example, from a suitable plastic.

Figure 1:
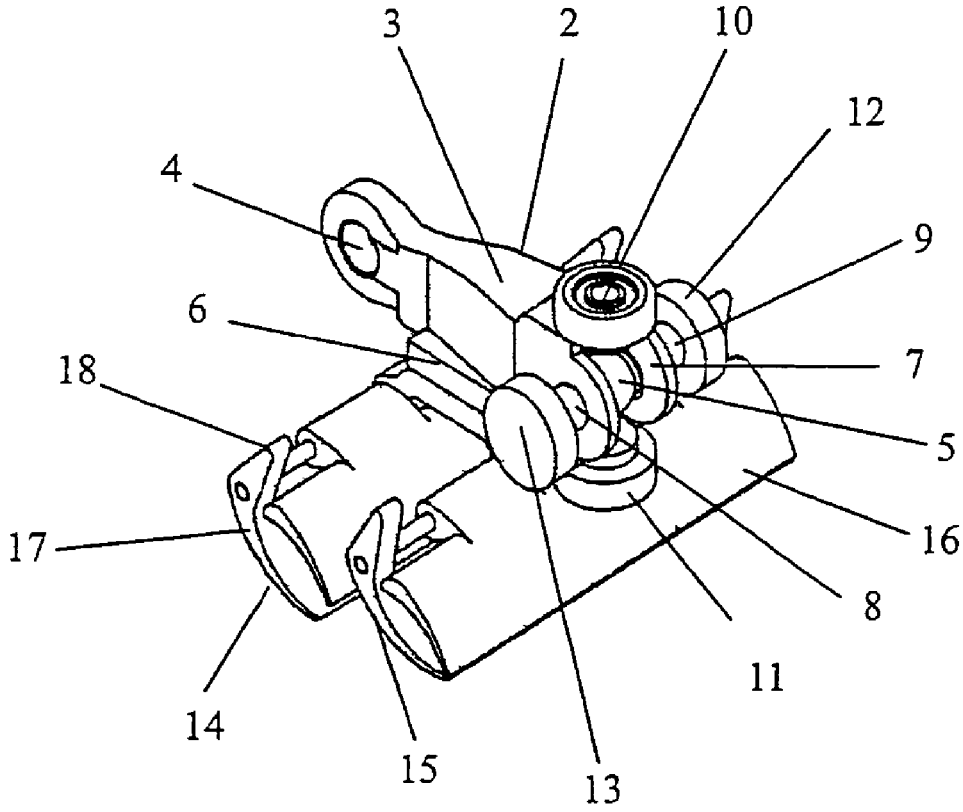
FIG. 1 is a perspective, schematical view of a chain link.
Figure 2:
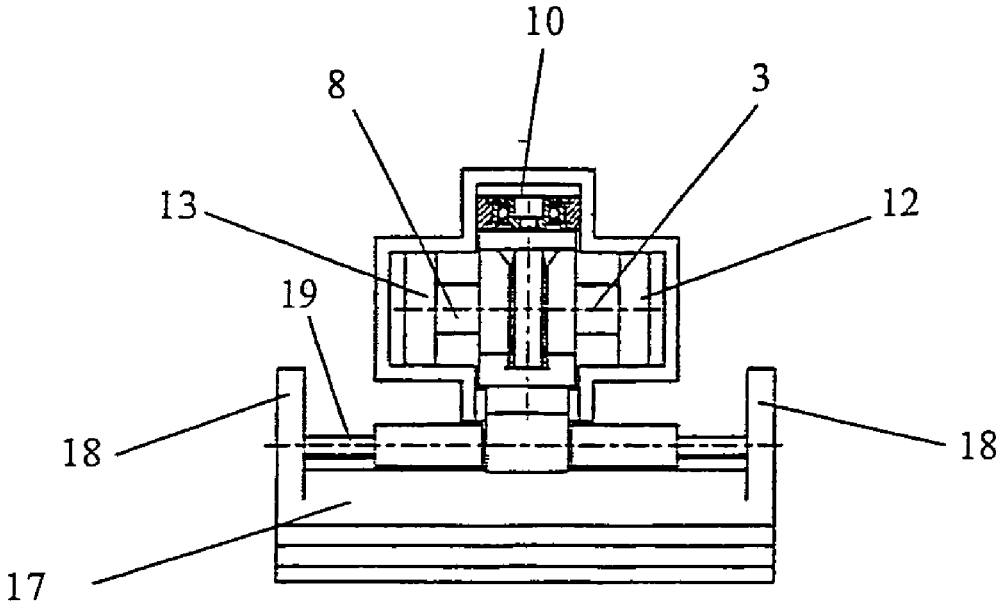
FIG. 2 is a partial sectional view of the chain link according to FIG. 1 including a sectional view through a guide rail.

The clamps 14 and 15 may be of identical design and each may have a bottom clamp jaw 17 and a top clamp jaw 16. The top clamp jaws 16 are fastened in an immovable manner on the body 3, while the bottom clamp jaws 17 can each be pivoted about a spindle 19. The spindles 19 are each mounted in bearing openings, not shown, of the carrier 6. The bottom clamp jaws 17 are pivoted by a control guide, not shown, which acts on levers 18, which levers 18 are each integrally formed on a bottom clamp 17, and, as can be seen in FIG. 1, extend upwards from the spindle 19. Each bottom clamp jaw 17 preferably has in each case two spaced-apart levers 18.

Pivoting the bottom clamp jaw 17 makes it possible to open and close a clamp mouth 20 according to FIG. 3. As has already been explained, only the bottom clamp jaw 17 is pivoted. In FIG. 3, the clamp 15, which is shown on the far right is closed, while the adjacent front clamp 14 has already been opened some way by the action of the guide. The front clamp 14, which is shown on the far left in FIG. 3 is completely closed again. The clamps 14 and 15 are opened and closed as the chain is running. In the same direction but at a somewhat higher speed, an imbricated stream S formed from printed products D is guided beneath the transporting mechanism 1 on a transporting belt B which is merely schematically indicated here. These printed products D are, in particular, and for example, newspapers, a fold F leading in each case here. The imbricated stream S is likewise merely schematically indicated here. The printed products D of the imbricated stream S are each gripped individually by the transporting mechanism 1.

In FIG. 3, T is used to indicate the clamp spacing. This spacing T corresponds to the spacing between adjacent clamps 14 and 15, and over the entire length of the transporting mechanism 1. This clamp spacing T is the same for all the clamps 14 and 15. The spacing between the two clamps 14 and 15 of one link chain 2 is thus equal to the spacing between the two clamps 14 and 15 of adjacent link chains 2. The spacing T is, for example, 3". The spacing A between the ball-and-socket joints G of a chain link 2 is equal to two spacings T and, in the given example, is thus 6". The spacing A between adjacent ball-and-socket joints G is thus greater than in a comparable chain link with one clamp and the spacing T is smaller than in a comparable transporting mechanism 1 with one clamp per chain link.

In order that the spacing can be kept particularly small, it is provided that the clamps 14 and 15 are inclined downwards in relation to the longitudinal extension of the bodies 3, according to FIG. 3. The angle $\alpha$, which is indicated on the far right in FIG. 3, is preferably significantly smaller than 90°, preferably approximately 45°. This inclined arrangement of the clamps 14 and 15 has, as has been mentioned, the advantage that the spacing T can be selected to be even smaller. While maintaining the same conveying capacity, the running speed can thus be decreased even further. It is thus possible to reduce, in particular, the noise and the wear.

Since the spacing A between adjacent joints G is greater than in comparable chain links with one clamp, the chain links are thus longer. This has the significant advantage that the actuating forces of the clamps 14 and 15 on these chain links 2 can be better absorbed and the risk of vibration can be reduced. In addition, there is less loading on the joints G and less wear to the latter.

The transporting mechanism 1 has, as explained above, chain links 2 on which two clamps 14 and 15 are mounted. It is also conceivable here, however, to have a configuration in which more than two clamps are fastened on the chain links 2. In the case of the above-mentioned exemplary embodiment, the chain links 2 are connected-to one another by ball-and-socket joints G and guided by rollers 10 to 13. It is also possible, however, to have a configuration in which other joints and guide means are used. In particular, a configuration with fewer than four rollers 10 to 13 is conceivable.

The invention is not limited by the embodiments described above which are presented as examples only but can be modified in various ways within the scope of the protection defined by the appended patent claims.

We claim:

1. In a transporting mechanism having a link chain with chain links fixed to one another and clamps attached to the chain links, wherein each clamp is adapted to grip at least one printed product, wherein the improvement comprises that at least two clamps are attached behind one another to each chain link of the link chain, and that the clamps in the link chain are spaced apart from one another by equal spacings in a conveying direction of the transporting mechanism.

2. The transporting mechanism according to claim 1, wherein the clamps are attached to the chain links so as to be directed downwardly.

3. The transporting mechanism according to claim 2, wherein the clamps are directed obliquely downwardly and against a running direction of the link chain.

4. The transporting mechanism according to claim 1, wherein each clamp has a first leading clamp jaw and a second trailing clamp jaw.

5. The transporting mechanism according to claim 4, wherein at least the first clamp jaw is pivotably controllably attached to the chain link.

6. The transporting mechanism according to claim 4, wherein at least the first clamp jaw is immovably attached to a body of a chain link.

* * * * *